United States Patent [19]

Wheeler

[11] Patent Number: 4,577,726

[45] Date of Patent: Mar. 25, 1986

[54] SAILBOAT MAST LADDER

[76] Inventor: Gary Wheeler, 855 China Basin, San Francisco, Calif. 94107

[21] Appl. No.: 738,923

[22] Filed: May 29, 1985

[51] Int. Cl.[4] ..... B63B 35/28; B63B 29/20; E06C 1/56; E06C 9/14

[52] U.S. Cl. ..... 182/93; 182/70; 182/100; 182/190; 182/196; 114/39; 114/362

[58] Field of Search ..... 182/190, 189, 93, 100, 182/197, 70; 114/362, 39

[56] References Cited

U.S. PATENT DOCUMENTS

| | | | |
|---|---|---|---|
| 186,424 | 1/1877 | Jones | 182/189 |
| 294,360 | 3/1884 | Borgfeldt | 182/190 |
| 2,975,858 | 3/1961 | Billingsley | 114/362 |
| 3,817,351 | 6/1974 | Mikkelson | 182/196 |
| 3,930,562 | 1/1976 | Zorn | 182/189 |
| 4,014,057 | 3/1977 | Kuojarvi | 182/190 |
| 4,139,079 | 2/1979 | Clark | 182/100 |
| 4,258,828 | 3/1981 | Evans | 182/100 |
| 4,405,034 | 9/1983 | Dunne | 182/190 |

*Primary Examiner*—Reinaldo P. Machado
*Attorney, Agent, or Firm*—Townsend and Townsend

[57] ABSTRACT

A sailboat mast ladder, for use with a sailboat having a mast with a sail track extending along its length, includes a flexible, flat support strap having a number of foot loops, also made of flat strap material, at staggered positions on opposite sides of the support strap. The support strap and foot loops are formed from first and second flat straps each having alternating straight sections and foot loop sections, the foot loop sections of one strap being opposite the straight sections of the other strap. The bottom or instep portions of the foot loops are reinforced with flat strap material secured to the first and second flat straps. An end of a halyard is secured to the upper end of the support strap to raise the mast ladder up the mast. A number of guides are secured along the inner edge of the support strap for sliding engagement with track slides of the main sail track to keep the ladder against the mast.

10 Claims, 3 Drawing Figures

SAILBOAT MAST LADDER

BACKGROUND OF THE INVENTION

It is often necessary for one to climb up the mast of a sailboat for various purposes, such as when performing normal maintenance, straightening fouled lines, and so forth. One traditional way to provide access to the top of a mast is by permanently mounting steps to the mast. However, this has several disadvantages, including chafing of the sails, snagging of halyards, and creating less than optimum wind resistance. Alternatively, a boatswain's chair has been used to gain access to the upper reaches of the mast. The boatswain's chair is a short board secured by ropes to the main halyard so that the person can, alone or with the help of others, lift himself or herself up the mast. However, this is a rather tedious system to use. It is also an unstable platform from which to work in that the boatswain's chair can swing away from the mast when the boat is rolling or pitching.

SUMMARY OF THE INVENTION

The invention is directed to a sailboat mast ladder for use with a sailboat having a mast with a main sail track extending along its length. The mast ladder includes a flexible, flat support strap to which a number of foot loops mounted at staggered intervals on opposite sides of the support strap. The main sail halyard is secured to the upper end of the support strap to raise the mast ladder up along the mast and support it when raised. A number of track slides are secured to the support strap at intervals along its length. The track slides slide along a sail track which extends up the mast. This keeps the flexible mast ladder secured against the mast. The bottom or instep portions of the foot loops are adapted to form openings for the receipt of a user's foot as the user climbs up the mast using foot loops as steps.

A primary advantage of the applicant's invention is that it eliminates many of the problems associated with permanent mast ladders and boatswain's chairs. The invention is mounted to the mast only when needed, to eliminate the problems associated with permanent steps, but still provides a stable platform, one not subject to swinging away from the mast as is a boatswain's chair.

A key feature of the invention is its use of flat straps for both the vertical support member and for the foot loops. This permits the mast ladder to be rolled up and stored in a compact space. This is very important on sailboats where space is at a premium.

A further advantage is that nothing on the sailboat needs to be modified to use the invention. The sail track already exists for the mainsail. If desired, the same track guides which engage the sail track and used to connect to the sail to the mast can be connected to the mast ladder by shackles.

Other features and advantages of the present invention will appear from the following description in which the preferred embodiment has been set forth in detail in conjunction with the accompanying drawings.

DETAILED DESCRIPTION OF THE PREFERRED EMBODIMENT

Figure 1:
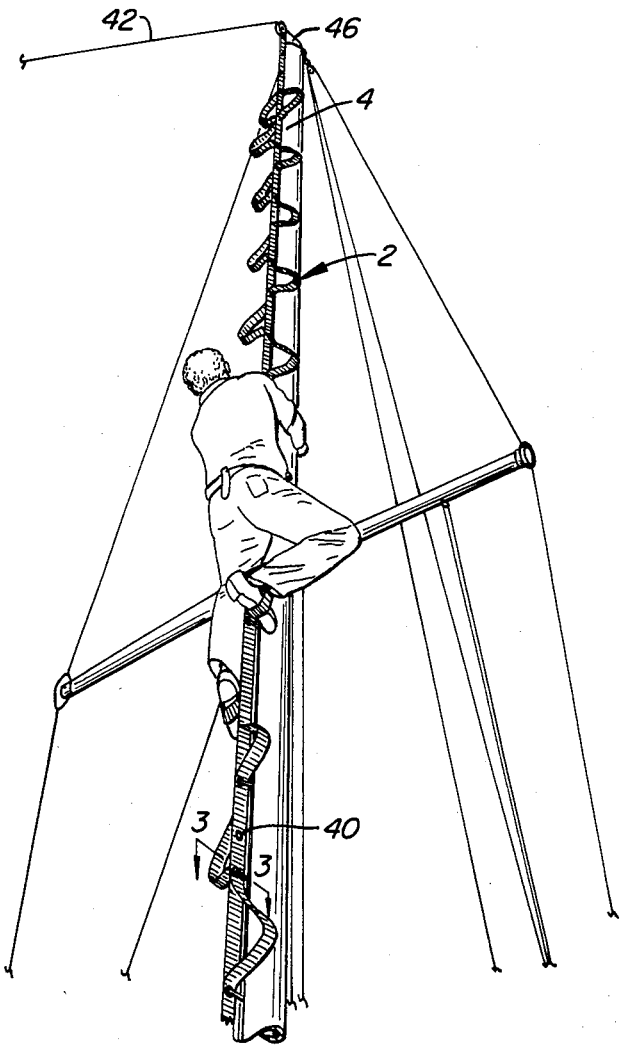
FIG. 1 is a perspective view showing the mast ladder made according to the invention in use.
Figure 2:
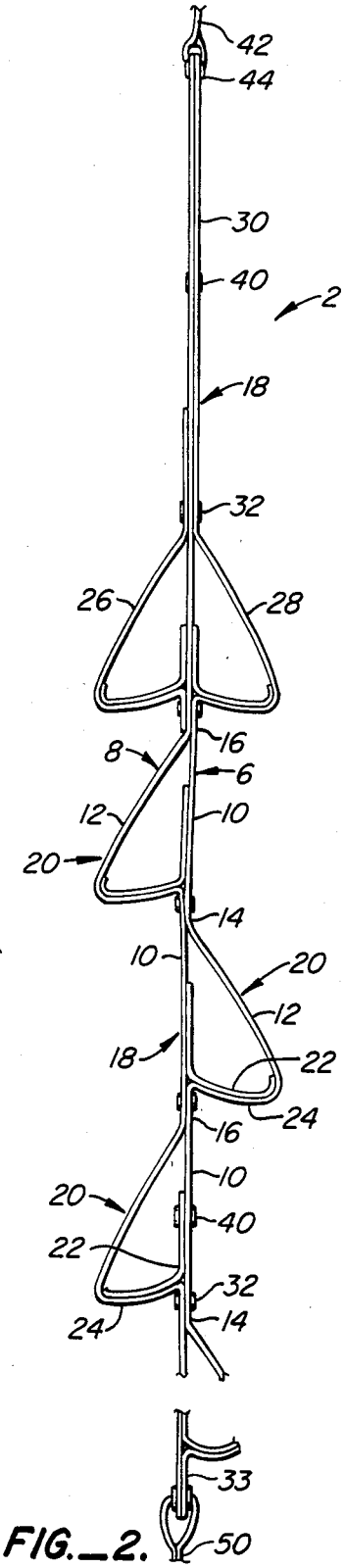
FIG. 2 is a side view detail showing the construction of the mast ladder of FIG. 1.
Figure 3:
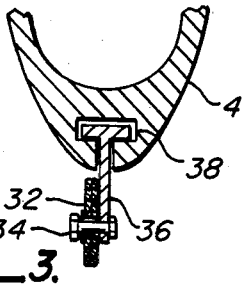
FIG. 3 is a cross-sectional view of a portion of the mast and the mast ladder of FIG. 1 taken along line 3—3.

Referring to the figures, a mast ladder 2 made according to the invention is shown mounted to a mast 4 of a sailboat (not shown). Mast ladder 2 includes first and second straps 6, 8, typically made of nylon strapping two inches wide. Straps 6, 8 are sewn to one another at evenly spaced intervals along the length of mast ladder 2. As shown in FIG. 3, each strap 6, 8 includes alternating straight sections 10 and foot loop sections 12. Straps 6, 8 are sewn to one another at positions 14 and 16, positions 14 at the top of foot loop sections 12 of first strap 6 and at the beginning of straight sections 10 of second strap 8; positions 16 are at the beginning of straight sections 10 of first strap 6 and at the beginning of foot loop sections 12 of second strap 8. Thus, straight sections 10 of first and second straps 6, 8 act as the support strap 18 of mast ladder 2 while sections 12 create the foot loops 20 of ladder 2.

To reduce the stress at positions 14, 16, a reinforcing strap segment 22 is mounted at the instep portion 24 of foot loops 20. Segments 22 are fastened, such as by sewing, to the adjacent straight and foot loop sections 10, 12. The use of strap segments 22 also helps to keep foot loops 20 open, so to be easily engageable by the user. An additional foot loop 26 is secured to second strap 8 opposite the foot loop 28 formed by first strap 6 adjacent the upper end 30 of mast ladder 2. This double foot loop provides the user with a secure working platform at the top of mast ladder 2.

A number of grommets 32 are positioned along mast ladder 2 adjacent positions 14, 16 at upper end 30 and at lower end 33. Shackles 34, which pass through grommets 32, connect to track slides 36 which move along the sail track 38 of mast 4. Track slides 36 are the slides normally used to connect the main sail to mast 4. Supplemental grommets 40 are positioned along straight sections 10 to permit the user to clip a safety harness onto mast ladder 2.

To raise mast ladder 2, the user connects the main sail halyard 42 to a grommet 44 at upper end 30 of mast ladder 2. As mast ladder 2 is pulled up towards the top 46 of mast 4, shackles 34 are connected to track slides 36, which extend from main sail track 38. When mast ladder 2 is fully raised, lower end 33 is secured in place by a downhaul 50. Alternatively, lower end 33 could be secured in other manners, such as to a boom. After securing mast ladder 2 in place, the user can climb mast 4 inserting his or her feet into foot loops 20. When mast ladder 2 is no longer needed, it is removed from mast 4. The various components of mast ladder 2 are made of flat strapping material which is sewn together so that when mast ladder 2 is rolled up, the material lies generally flat against itself so the mast ladder can be rolled up into a very compact form for storage. This is very important on sailboats where storage space is at a premium.

Modification and variation can be made to the disclosed embodiment without departing from the subject of the invention as defined in the following claims. For example, according to the broad aspect of the invention, support strap 18 could be formed from a single, straight length of material and have separate foot loops 20 secured on alternating sides of the support strap.

I claim:

1. A mast ladder for use with a mast on a sailboat of the type having a sail track along the length of the mast and a halyard extending from an upper portion of the mast, the mast ladder comprising:

a flexible, flat support strap having inner and outer edges, first and second opposite sides, an upper end and a lower end;

a plurality of foot loops extending from the first and second support strap sides at alternating positions along the support strap, the foot loops sized for receipt of a user's foot; and means for coupling the inner edge of the support strap to the sail track; whereby securing the halyard to the upper support strap end permits the user to raise and lower the mast ladder along the mast with the inner support strap edge guided along the sail track.

2. The mast ladder of claim 1 wherein the support strap is a length of nylon webbing.

3. The mast ladder of claim 2 wherein the support strap is about 2 inches wide.

4. The mast ladder of claim 1 wherein the foot loops comprise flat strap material.

5. The mast ladder of claim 1 wherein the support strap and foot loops are formed from first and second straps having alternating straight sections and foot loop section, the straight sections of said first strap being opposite the foot loop sections of the second strap, the first and second straps secured together at positions on either side of the foot loop sections so the straight sections constitute said support strap.

6. The mast ladder of claim 5 wherein the foot loops each include a reinforcing strap segment secured to straight and foot loop sections of said first and second straps.

7. The mast ladder of claim 1 wherein the support strap further includes at least one supplemental attachment point along its length.

8. The mast ladder of claim 1 wherein the coupling means includes a plurality of shackles connected to the flat support strap at positions along its length, the shackle adapted to connect to slides engaging the sail track.

9. A mast ladder for use with a sail boat mast assembly including an upright mast having a base and a top, a main halyard extending upwardly to a position toward the mast top, and a track extending along the mast having a plurality of track guides, the mast ladder comprising:

first and second flexible flat straps having alternating straight sections and foot loop sections, the straight sections of said first strap being opposite the foot loop sections of the second strap, the first and second straps secured together at positions on either side of the foot loop sections;

the straight sections forming an elongate, flexible flat support strap having first and second sides opposite one another, outer and inner edges and an upper end connected to the main halyard;

the foot loop sections forming a plurality of generally flexible foot loops alternatingly spaced along the first and second support strap sides, the foot loops including instep portions for receiving a user's foot;

flat strap reinforcing strap segments secured to the first and second straps at the instep portions of the foot loops; and a plurality of shackles, secured to the support strap at chosen intervals along the inner edge, for connection to the track guides to keep the mast ladder adjacent the mast.

10. The mast assembly of claim 9 wherein the support strap includes reinforced openings acting as supplemental attachment points.

* * * * *